US012352124B2

(12) United States Patent
Kent

(10) Patent No.: US 12,352,124 B2
(45) Date of Patent: Jul. 8, 2025

(54) TWO-STAGE TORQUE RELEASE SUB

(71) Applicant: SBS Technology AS, Indre Arna (NO)

(72) Inventor: Anthony Kent, Houston, TX (US)

(73) Assignee: SBS TECHNOLOGY AS, Indre Arna (NO)

( * ) Notice: Subject to any disclaimer, the term of this patent is extended or adjusted under 35 U.S.C. 154(b) by 48 days.

(21) Appl. No.: 18/449,782

(22) Filed: Aug. 15, 2023

(65) Prior Publication Data

US 2024/0052719 A1 Feb. 15, 2024

Related U.S. Application Data

(60) Provisional application No. 63/397,929, filed on Aug. 15, 2022.

(51) Int. Cl.
*E21B 31/107* (2006.01)

(52) U.S. Cl.
CPC ..... *E21B 31/107* (2013.01)

(58) Field of Classification Search
CPC .... E21B 17/046; E21B 17/02; E21B 17/0465; E21B 17/06; E21B 31/107
See application file for complete search history.

(56) References Cited

U.S. PATENT DOCUMENTS 5,086,843 A * 2/1992 Mims ..... F16L 25/08 175/320
5,404,944 A * 4/1995 Lynde ..... E21B 23/0411 166/117.7
5,857,710 A 1/1999 Leising et al.
6,450,541 B1 9/2002 Bakke
2003/0166418 A1* 9/2003 Wentworth ..... E21B 17/046 464/18
2007/0029095 A1* 2/2007 Brisco ..... E21B 23/02 166/207
2011/0150596 A1* 6/2011 Wolodko ..... E21B 17/06 29/525.13
2014/0353045 A1* 12/2014 Zhang ..... E21B 17/043 175/320
2017/0356252 A1* 12/2017 Wollmann ..... E21B 17/1071
2019/0010768 A1* 1/2019 Cosse ..... E21B 17/046

FOREIGN PATENT DOCUMENTS

GB 2536963 A 10/2016

* cited by examiner

*Primary Examiner* — David Carroll
(74) *Attorney, Agent, or Firm* — ArentFox Schiff LLP

(57) ABSTRACT

A decoupling apparatus for use in a wellbore includes a top sub section and a bottom sub section rotationally coupled to the top sub section. The bottom and top sub sections are aligned along a decoupling apparatus axis. A torque ring is disposed between the top sub section and the bottom sub section. A method for decoupling a lower tubular section from an upper tubular section of a stuck downhole tubular string including the decoupling apparatus includes identifying the stuck downhole tubular string. A first torque is applied to an upper tubular section to rotate a top sub section from a first configuration to a second configuration. A second torque is applied to the upper tubular section to rotate the top sub section from the second configuration to a third configuration in which the top and bottom sub sections are decoupled from one another.

14 Claims, 3 Drawing Sheets

TWO-STAGE TORQUE RELEASE SUB

FIELD OF THE INVENTION

The present invention relates to downhole wellbore tubular strings, and more specifically to release sub apparatuses for releasing stuck portions of downhole tubular strings.

BACKGROUND OF THE INVENTION

In any case of a stuck tubular string, it can be helpful to jar on the string by applying a tensile load to the stuck assembly. When the jar hits, it causes a sudden shock on the string intended to be freed. Such shocks will be transferred through the pipe and threaded connections in between each pipe section. It is possible that the shocks may weaken the connection strength and in some cases cause a threaded connection to lose its resistance to torque ("break" or "broken connection"), thereby allowing free rotation of the threaded connection in the release direction. If the jarring results in the freeing of the stuck tubular string section, it is then desirable to retrieve the entire string from the wellbore. However, if the same jarring has also caused a threaded connection to break, then retrieving the entirety of the freed string may not be possible, as the hanging weight of the string below the break can cause the broken connection to back off while pulling it out of hole. If this happens, the lower portion of the string will drop back into the well, resulting in possible damage to components of that lower portion and require another time-consuming string retrieval trip. It is common in tubular strings to incorporate a type of release sub, which requires less torque to break than other connections in the string, thereby giving a user control of where a string can be separated in case jarring does not release the stuck portion of the string. However, being that the release subs intentionally require less torque to break, it is even more likely that jarring will cause the release subs to release, thereby presenting a risk that the lower portion of the string is left in hole even if it is not stuck.

BRIEF SUMMARY OF THE INVENTION

According to an embodiment of the present disclosure, a decoupling apparatus for use in a wellbore is disclosed. The apparatus includes a top sub section and a bottom sub section rotationally coupled to the top sub section. The bottom sub section and the top sub section are aligned along a decoupling apparatus axis. A torque ring is disposed between the top sub section and the bottom sub section. The apparatus is advantageous in that the torque ring of the decoupling apparatus provides a necessary torsional resistance to prevent the lower portion of the string from detaching from the upper portion of the string when jarring occurs.

In one embodiment, which can be combined with the previous embodiment, the torque ring is axially restrained to the top sub section via one or more retaining devices mechanically affixed to the torque ring and extending inwardly through a recess of the top sub section. This configuration is advantageous in that additional subcomponents of the decoupling apparatus (torque ring) are returned to the surface instead of being left in the well, which reduces the likelihood of mechanical issues.

In another embodiment, which can be combined with the previous embodiments, the torque ring is rotationally restrained to the top sub section via one or more shearable elements each positioned within a respective one of one or more through holes of the torque ring and within a respective one of one or more spot face holes of the top sub section.

In another embodiment, which can be combined with the previous embodiments, each of the torque ring and the top sub section comprise a greater yield strength than each of the one or more shearable elements. This configuration is advantageous in that the shearing of the shearable elements causes no mechanical deformation of either the torque ring or the top sub section.

In another embodiment, which can be combined with the previous embodiments, the torque ring includes a pair of diametrically opposed upper torque protrusions disposed about a circumference of the decoupling apparatus and the bottom sub section includes a pair of diametrically opposed lower torque protrusions disposed about a circumference of the decoupling apparatus.

In another embodiment, which can be combined with the previous embodiments, the torque ring includes at least one upper torque protrusion each disposed a circumferential distance from each of at least one lower torque protrusion of the bottom sub section when the decoupling apparatus is in a first configuration.

In another embodiment, which can be combined with the previous embodiments, the at least one upper torque protrusion and the at least one lower torque protrusion are positioned along a plane perpendicular to the decoupling apparatus axis.

In another embodiment, which can be combined with the previous embodiments, a first torque is applied to the top sub section to rotate the decoupling apparatus from the first configuration to a second configuration in which each of the at least one upper torque protrusion contacts a respective one of the at least one lower torque protrusion along the circumference of the decoupling apparatus.

In another embodiment, which can be combined with the previous embodiments, a second torque is applied to the top sub section to rotate the decoupling apparatus from a second configuration to a third configuration in which the top sub section and the bottom sub section are decoupled from one another.

In another embodiment, which can be combined with the previous embodiments, a shear strength of one or more shearable elements each positioned within a respective one of one or more through holes of the torque ring and within a respective one of one or more spot face holes of the top sub section are overcome to allow the rotation of the top sub section from the second configuration to the third configuration during the applying of the second torque.

In another embodiment, which can be combined with the previous embodiments, the second torque is greater than the first torque.

In another embodiment, which can be combined with the previous embodiments, one or more retaining devices mechanically affixed to the torque ring are positioned above one or more shearable elements rotationally restraining the torque ring to the top sub section.

According to an embodiment of the present disclosure, a method for decoupling a lower tubular section from an upper tubular section of a stuck downhole tubular string having a decoupling apparatus is disclosed. The method includes identifying the stuck downhole tubular string having the decoupling apparatus, where the decoupling apparatus includes a top sub section affixed to the upper tubular section and a bottom sub section affixed to the lower tubular section and rotationally coupled to the top sub section. The decoupling apparatus further includes a torque ring disposed between the top sub section and the bottom sub section, where the torque ring is rotationally restrained to the top sub section via one or more shearable elements. In relation to the method, a first torque is then applied to the upper tubular section to rotate the top sub section from a first configuration in which each of at least one upper torque protrusion of the torque ring is separated from each of at least one lower torque protrusion of the bottom sub section by an arc distance along a circumference of the decoupling apparatus to a second configuration in which each of the at least one upper torque protrusion contacts a respective one of the at least one lower torque protrusion along the circumference of the decoupling apparatus. A second torque is then applied to the upper tubular section to rotate the top sub section from the second configuration to a third configuration in which the top sub section and the bottom sub section are decoupled from one another. The method is advantageous in that the torque ring of the decoupling apparatus provides a necessary torsional resistance to prevent the lower portion of the string from detaching from the upper portion of the string when jarring occurs.

In one embodiment, which can be combined with the previous embodiment, during the applying of the second torque, the shear strength of the one or more shearable elements are overcome to allow the rotation of the top sub section from the second configuration to the third configuration.

In another embodiment, which can be combined with the previous embodiments, the torque ring is axially restrained to the top sub section via one or more retaining devices mechanically affixed to the torque ring and extending inwardly through a recess of the top sub section. This methodology is advantageous in that additional subcomponents of the decoupling apparatus (torque ring) are returned to the surface instead of being left in the well, which reduces the likelihood of mechanical issues.

In another embodiment, which can be combined with the previous embodiments, the one or more retaining devices are positioned above the one or more shearable elements.

In another embodiment, which can be combined with the previous embodiments, the one or more retaining devices are positioned below the one or more shearable elements.

In another embodiment, which can be combined with the previous embodiments, each of the torque ring and the top sub section comprise a greater yield strength than each of the one or more shearable elements. This methodology is advantageous in that the shearing of the shearable elements causes no mechanical deformation of either the torque ring or the top sub section.

In another embodiment, which can be combined with the previous embodiments, the at least one upper torque protrusion includes a pair of diametrically opposed upper torque protrusions and the at least one lower torque protrusion includes a pair of diametrically opposed lower torque protrusions.

In another embodiment, which can be combined with the previous embodiments, the at least one upper torque protrusion and the at least one lower torque protrusion are positioned along a plane perpendicular to a decoupling apparatus axis.

In another embodiment, which can be combined with the previous embodiments, the second torque is greater than the first torque.

BRIEF DESCRIPTION OF THE DRAWINGS

The disclosed subject matter, objectives, and advantages thereof, will best be understood by reference to the following detailed description of an illustrative embodiment when read in conjunction with the accompanying drawings, wherein.

DETAILED DESCRIPTION

Reference now should be made to the drawings, in which the same reference numbers are used throughout the different figures to designate the same components.

It will be understood that, although the terms first, second, third, etc. may be used herein to describe various elements, these elements should not be limited by these terms. These terms are only used to distinguish one element from another element. Thus, a first element discussed below could be termed a second element without departing from the teachings of the present disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
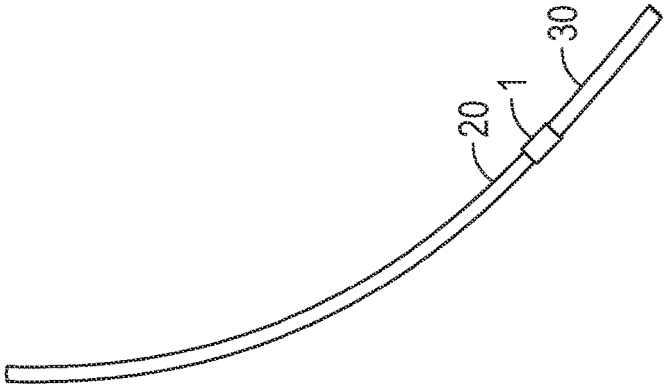
FIG. 1 displays a decoupling apparatus positioned on a tubular string, consistent with an illustrative embodiment.

FIG. 1 displays a decoupling apparatus 1 positioned on a tubular string, consistent with an illustrative embodiment. As shown, decoupling apparatus 1 is configured as a two-stage torque decoupling apparatus. Tubular string includes an upper end 2 and a lower end 3 with decoupling apparatus 1 adjoining the upper and lower ends 2,3. Decoupling apparatus 1 is configured to act as a controlled release point when lower end 3 becomes stuck during well operations so that upper end 2 can be retrieved and salvaged. Once upper end 2 and decoupling apparatus 1 are removed, lower end 3 can either be left in the wellbore or attempt to be retrieved using alternative tools or methods by the well operator.

Figure 2:
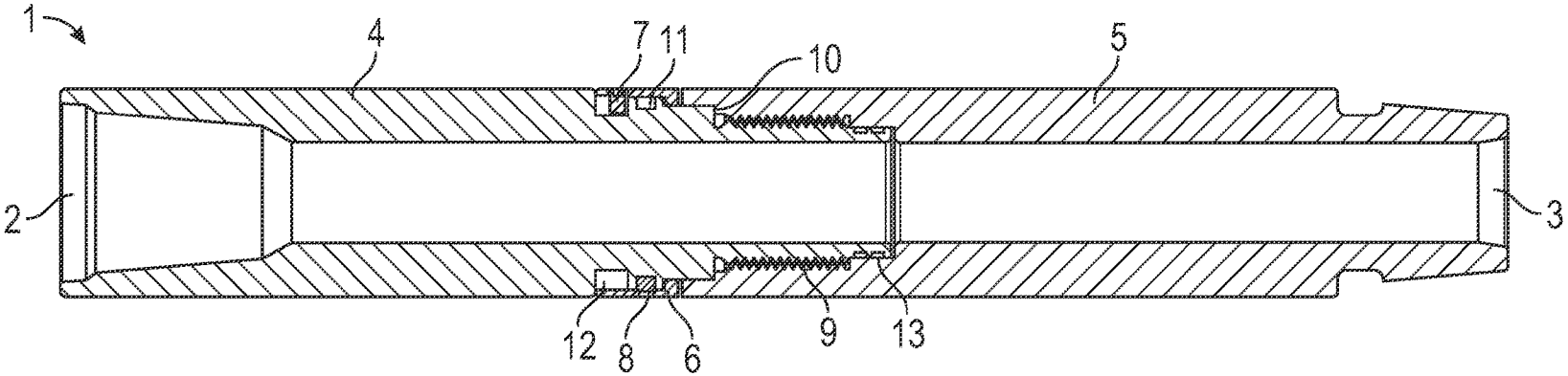
FIG. 2 displays a partial cross-sectional view of a decoupling apparatus, consistent with an illustrative embodiment.

Reference is now made to FIG. 2, which displays a partial cross-sectional view of a decoupling apparatus 1, consistent with an illustrative embodiment. As shown, decoupling apparatus 1 includes a top sub section 4 and a bottom sub section 5 sharing a sub axis and having respective top and bottom ends 2,3. Top sub section 4 and bottom sub section 5 are connected by a thread coupling 9 that is configured to be torqued against shoulder 10 between the two components (top sub section 4 and bottom sub section 5). Seal members 13 sit below thread coupling 9 to seal top sub section 4 against an inner surface of bottom sub section 5 for the prevention of the transfer of fluid out of the decoupling apparatus 1.

A torque ring 6 residing between top sub section 4 and bottom sub section 5 is axially restrained with top sub section 4 via one or more retaining devices 7. Retaining devices 7 are mechanically affixed to torque ring 6 and extend inwardly within recess 12. Retaining devices 7 function to keep torque ring 6 axially connected to top sub section 4 when top sub section 4 is detached from bottom sub section 5 (third configuration, see FIG. 5). One or more shearable elements 8 rotationally restrain torque ring 6 with top sub section 4. A first portion of each of the shearable elements 8 is positioned within spot face holes 11 spaced around the circumference of top sub section 4 while a second portion of each of the shearable elements 8 is positioned within through-holes of torque ring 6 spatially matching the spot face holes 11. When shearable elements 8 are positioned within spot face holes 11 and the spatially matching through-holes of torque ring 6, torque ring 6 is rotationally restrained with top sub section 4.

In an embodiment, the torque ring 6 is axially restrained to the top sub section 4 via one or more retaining devices 7 mechanically affixed to the torque ring 6 and extending inwardly through a recess 12 of the top sub section 4. This configuration is advantageous in that additional subcomponents of the decoupling apparatus (torque ring) are returned to the surface instead of being left in the well, which reduces the likelihood of mechanical issues.

In a further embodiment, the one or more retaining devices 7 are set screws that are threaded into threaded holes of torque ring 6 and protrude inwardly toward the axis of decoupling apparatus 1. When top sub section 5 is released from bottom sub section 4 (third configuration, see FIG. 5), the protruding nose(s) of the one or more retaining devices 7 (set screws) catch on a shoulder of top sub section 5, preventing torque ring 6 from sliding off of the end of top sub section 5 and keeping the torque ring 6 remaining in the well.

Figure 3:
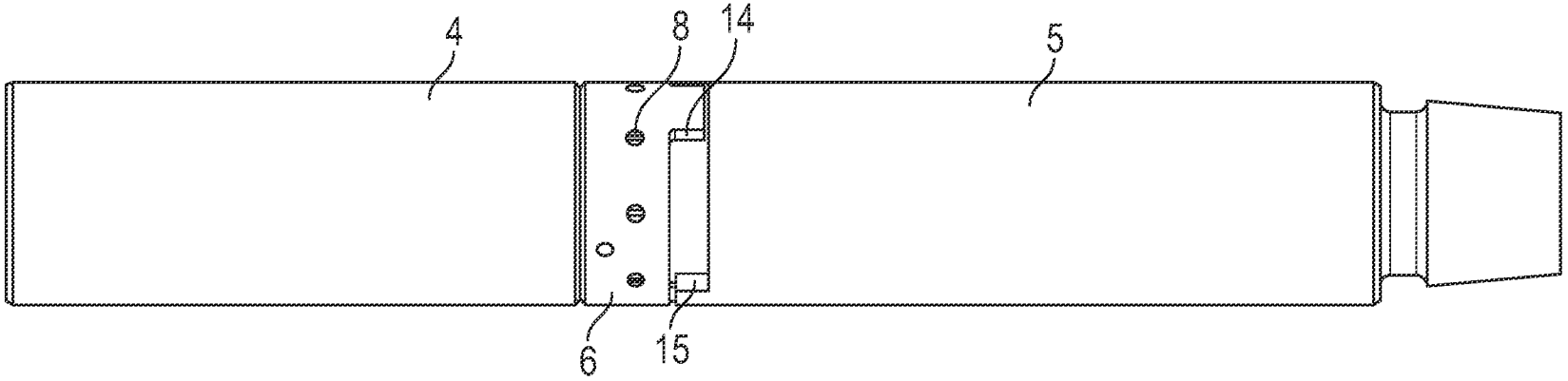
FIG. 3 displays a decoupling apparatus in a first configuration, consistent with an illustrative embodiment.

Reference is now made to FIG. 3, which displays a decoupling apparatus 1 in a first configuration, consistent with an illustrative embodiment. As shown, relative motion between top sub section 4 and bottom sub section 5 is prevented solely by the torque applied to thread coupling 9 (see FIG. 2) between top sub section 4 and bottom sub section 5. Torque ring 6 includes at least one upper torque protrusion 14 protruding axially towards bottom sub section 5. Similarly, bottom sub section 5 includes at least one lower torque protrusion 15 protruding axially towards torque ring 6 and located on the same plane as upper torque protrusion 14 perpendicular to the sub axis but separated by an arc distance along the circumference of decoupling apparatus 1.

In order to thread top sub section 4 to bottom sub section 5, shearable elements 8 (shown spaced around the circumference of torque ring 6 along an axis perpendicular to sub axis) must be removed from torque ring 6. Otherwise, torque ring 6 would be rotationally locked to top sub section 4 and an upper torque protrusion 14 would contact a lower torque protrusion 15. Once top sub section 4 is fully threaded and torqued to bottom sub section 5 via thread coupling 9, torque ring 6 can be rotated such that the through-holes of torque ring 6 align with spot face holes 11 in top sub section 4. In this configuration, shearable elements 8 can then be inserted into the spot face holes 11/through-holes.

Figure 4:
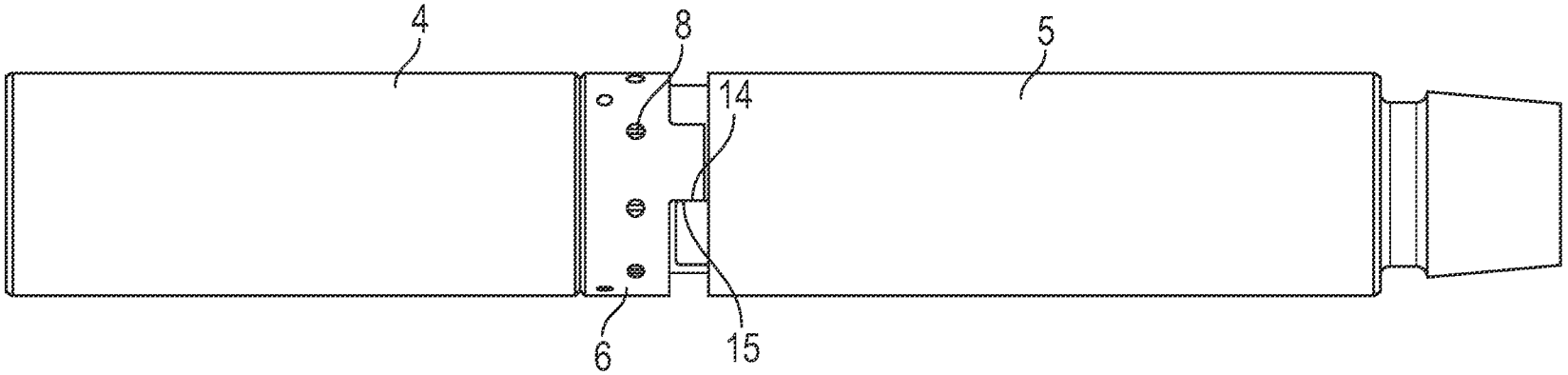
FIG. 4 displays a decoupling apparatus in a second configuration, consistent with an illustrative embodiment.

Reference is now made to FIG. 4, which displays a decoupling apparatus 1 in a second configuration, consistent with an illustrative embodiment. As shown, the torque of thread coupling 9 (see FIG. 2) has been relieved by partially turning top sub section 4 relative to bottom sub section 5 to where an upper and lower torque protrusion 14, 15 have come in contact with one another (via a first torque). In this second configuration, further rotation of the top sub section 4 relative to bottom sub section 5 can only occur after sufficient (a second) torque is applied to overcome the shear strength of shearable elements 8. If shearable elements 8 remain intact, top sub section 4 and bottom sub section 5 will remain axially connected via thread coupling 9. If shearable elements 8 are sheared, top sub section 4 can continue to turn relative to bottom sub section 5 and thread coupling 9 will eventually be disengaged.

In an embodiment, each of the torque ring 6 and the top sub section 4 include a greater yield strength than each of the one or more shearable elements 8. This configuration is advantageous in that the shearing of the shearable elements 8 causes no mechanical deformation of either the torque ring 6 or the top sub section 4. In a further embodiment, the one or more shearable elements 8 comprise at least one of: brass, bronze, aluminum, ceramic, or a composite material.

In a further embodiment, shearable elements 8 are threaded to at least one of torque ring 6 and top sub section 4 to provide additional friction between shearable elements 8 and torque ring 6 and/or top sub section 4 (assistance in keeping shearable elements 8 stationary).

Figure 5:
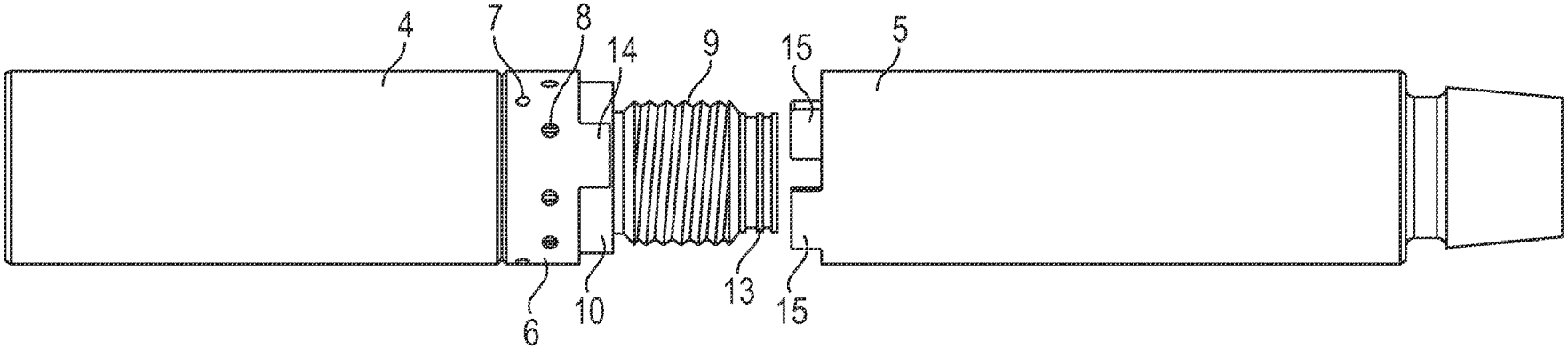
FIG. 5 displays a decoupling apparatus in a decoupled configuration, consistent with an illustrative embodiment.

Reference is now made to FIG. 5, which displays a decoupling apparatus 1 in a decoupled configuration (or third configuration), consistent with an illustrative embodiment. As shown, top sub section 4 and bottom sub section 5 are decoupled after shearable elements 8 have sheared and thread coupling 9 is fully disengaged. Additionally, in this embodiment, torque ring 6 includes two diametrically opposed upper torque protrusions 14 and bottom sub section 5 includes two diametrically opposed lower torque protrusions 15.

In an embodiment, in relation to the decoupling apparatus 1, in the first configuration, thread coupling 9 prevents relative rotation between top sub section 5 and bottom sub section 4. This coupling can be affected by shocks from 'jarring' and once the thread coupling 9 'breaks', the likelihood of free rotation of thread coupling 9 occurring at a much lesser torque increases. However, rotation does not occur due to gravity until the lower string portion of the string is no longer stuck and hanging from thread coupling 9. Further, in the second configuration, some rotation of thread coupling 9 has occurred such that upper and lower torque protrusions 14,15 are in contact with one another and a second application of torque must be applied to break shearable elements 8. If the lower string portion of the formerly "stuck" string is freed, then this second torque requirement prevents the lower string portion from rotationally (and eventually axially) decoupling from the upper string portion. However, if the lower string portion remains stuck, then torque would continue to be applied and decoupling apparatus 1 would be intentionally moved to the third configuration where the upper string portion (including top sub section 5) can be retrieved.

In a further embodiment, decoupling apparatus 1 is configured to be utilized in conjunction with a retrievable tubular string that includes a section that is at risk of being stuck in a well for any reason. It is noted that decoupling apparatus 1 is further configured to be placed immediately above the section that is at risk for sticking. In further embodiments, decoupling apparatus 1 can be applied to any of: drill strings, drill stem test strings, tubing conveyed perforating strings, or gravel packing strings.

TABLE 1

| | |
|---|---|
| Step 1 | Identifying the stuck downhole tubular string having the decoupling apparatus, the decoupling apparatus comprising: a top sub section affixed to the upper tubular section; a bottom sub section affixed to the lower tubular section and rotationally |

TABLE 1-continued

| | |
|---|---|
| | coupled to the top sub section; and a torque ring disposed on the top sub section between the top sub section and the bottom sub section, wherein the torque ring is rotationally restrained to the top sub section via one or more shearable elements. |
| Step 2 | Applying a first torque to the upper tubular section to rotate the top sub section from a first configuration in which each of at least one upper torque protrusion of the torque ring is separated from each of at least one lower torque protrusion of the bottom sub section by an arc distance along a circumference of the decoupling apparatus to a second configuration in which each of the at least one upper torque protrusion contacts a respective one of the at least one lower torque protrusion along the circumference of the decoupling apparatus. |
| Step 3 | Applying a second torque to the upper tubular section to rotate the top sub section from the second configuration to a third configuration in which the top sub section and the bottom sub section are decoupled from one another. |

Reference is now made to Table 1, which is a flowchart for a method for decoupling a lower tubular section from an upper tubular section of a stuck downhole tubular string having a decoupling apparatus 1. For discussion purposes, the decoupling method is described with reference to the elements of FIGS. 1-5. The method is advantageous in that the torque ring 6 of the decoupling apparatus 1 provides a necessary torsional resistance to prevent the lower portion of the string from detaching from the upper portion of the string when jarring occurs. At Step 1, the stuck downhole tubular string having the decoupling apparatus 1 is identified, where the decoupling apparatus includes a top sub section 4 affixed to the upper tubular section and a bottom sub section 5 affixed to the lower tubular section and rotationally coupled to the top sub section 4. The decoupling apparatus 1 further includes a torque ring 6 disposed between the top sub section 4 and the bottom sub section 5, where the torque ring 6 is rotationally restrained to the top sub section 4 via one or more shearable elements 8. At Step 2, a first torque is applied to the upper tubular section to rotate the top sub section 4 from a first configuration in which each of at least one upper torque protrusion 14 of the torque ring 6 is separated from each of at least one lower torque protrusion 15 of the bottom sub section 5 by an arc distance along a circumference of the decoupling apparatus 1 to a second configuration in which each of the at least one upper torque protrusion 14 contacts a respective one of the at least one lower torque protrusion 15 along the circumference of the decoupling apparatus 1. At Step 3, a second torque is applied to the upper tubular section to rotate the top sub section 4 from the second configuration to a third configuration in which the top sub section 4 and the bottom sub section 5 are decoupled from one another.

In an embodiment, during the applying of the second torque, the shear strength of the one or more shearable elements 8 are overcome to allow the rotation of the top sub section 4 from the second configuration to the third configuration.

In a further embodiment, the torque ring 6 is axially restrained to the top sub section 4 via one or more retaining devices 7 mechanically affixed to the torque ring 6 and extending inwardly through a recess 12 of the top sub section 4. This methodology is advantageous in that additional subcomponents of the decoupling apparatus (torque ring) are returned to the surface instead of being left in the well, which reduces the likelihood of mechanical issues.

In a further embodiment, the one or more retaining devices 7 are positioned above the one or more shearable elements 8.

In a further embodiment, each of the torque ring and the top sub section include a greater yield strength than each of the one or more shearable elements. This configuration is advantageous in that the shearing of the shearable elements causes no mechanical deformation of either the torque ring or the top sub section. In a further embodiment, the one or more shearable elements comprise at least one of: brass, bronze, aluminum, ceramic, or a composite material.

In a further embodiment, the at least one upper torque protrusion 14 includes a pair of diametrically opposed upper torque protrusions 14 and the at least one lower torque protrusion 15 includes a pair of diametrically opposed lower torque protrusions 15.

In a further embodiment, the at least one upper torque protrusion 14 and the at least one lower torque protrusion 15 are positioned along a plane perpendicular to a decoupling apparatus axis.

In a further embodiment, the second torque is greater than the first torque.

In a further embodiment, shearable elements 8 are threaded to at least one of torque ring 6 and top sub section 4 to provide additional friction between shearable elements 8 and torque ring 6 and/or top sub section 4 (assistance in keeping shearable elements 8 stationary).

In embodiments, torque ring 6 is axially restrained with top sub section 4 via one or more retaining devices 7. In this embodiment, retaining devices 7 can be aligned along a plane perpendicular to the sub axis.

In embodiments, each of the one or more shearable elements 8 are secured within the through-holes of torque ring 6 and aligned spot face holes 11 via an interference fit. An interference fit in relation to the one or more shearable elements 8 and the through-holes of torque ring 6 and/or spot face holes 11 is advantageous in that the one or more shearable elements 8 are prevented from travelling orthogonally to the sub axis and premature dislodging of the one or more shearable elements is avoided.

In embodiments, the second torque applied to top sub section 4 to rotate decoupling apparatus 1 from a second configuration to a third configuration (in which top sub section 4 and bottom sub section 5 are decoupled from one another) is greater than the first torque applied to top sub section 4 to rotate decoupling apparatus 1 from a first configuration to a second configuration (in which each of the at least one upper torque protrusion 14 contacts a respective one of the at least one lower torque protrusion 15 along the circumference of the decoupling apparatus 1).

For the purposes of this disclosure, the terms "decoupling apparatus", "release sub", and "release sub apparatus" may be synonymous.

Unless otherwise defined, all technical and scientific terms used herein have the same meanings as are commonly understood by one of ordinary skill in the art to which this disclosure belongs. Although methods similar or equivalent to those described herein can be used in the practice or testing of the present disclosure, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present disclosure is not limited to what has been particularly shown and described hereinabove. Rather, the scope of the present disclosure is defined by the appended claims and includes both combinations and sub-combinations of the various features described hereinabove as well as variations and modifications thereof, which would occur to persons skilled in the art upon reading the foregoing description.

I claim:

1. A decoupling apparatus for use in a wellbore, comprising:

a top sub section;

a bottom sub section rotationally coupled to the top sub section, the bottom sub section and the top sub section aligned along a central axis of the decoupling apparatus, and a torque ring disposed between the top sub section and the bottom sub section, wherein the torque ring is rotationally restrained to the top sub section via one or more shearable elements each positioned within a respective one of one or more through holes of the torque ring and within a respective one of one or more spot face holes of the top sub section.

2. The apparatus of claim 1, wherein each of the torque ring and the top sub section comprise a greater yield strength than each of the one or more shearable elements.

3. The apparatus of claim 1, wherein the torque ring includes a pair of diametrically opposed upper torque protrusions disposed about a circumference of the decoupling apparatus and the bottom sub section includes a pair of diametrically opposed lower torque protrusions disposed about a circumference of the decoupling apparatus.

4. The apparatus of claim 1, wherein the torque ring includes at least one upper torque protrusion each disposed a circumferential distance from each of at least one lower torque protrusion of the bottom sub section when the decoupling apparatus is in a first configuration.

5. The apparatus of claim 4, wherein the at least one upper torque protrusion and the at least one lower torque protrusion are positioned along a plane perpendicular to the central axis of the decoupling apparatus.

6. The apparatus of claim 1, wherein one or more retaining devices mechanically affixed to the torque ring are positioned above one or more shearable elements rotationally restraining the torque ring to the top sub section.

7. A method for decoupling a lower tubular section from an upper tubular section of a stuck downhole tubular string having a decoupling apparatus, comprising:

identifying the stuck downhole tubular string having the decoupling apparatus, the decoupling apparatus comprising:

a top sub section affixed to the upper tubular section;

a bottom sub section affixed to the lower tubular section and rotationally coupled to the top sub section; and a torque ring disposed between the top sub section and the bottom sub section, wherein the torque ring is rotationally restrained to the top sub section via one or more shearable elements;

applying a first torque to the upper tubular section to rotate the top sub section from a first configuration in which each of at least one upper torque protrusion of the torque ring is separated from each of at least one lower torque protrusion of the bottom sub section by an arc distance along a circumference of the decoupling apparatus to a second configuration in which each of the at least one upper torque protrusion contacts a respective one of the at least one lower torque protrusion along the circumference of the decoupling apparatus;

applying a second torque to the upper tubular section to rotate the top sub section from the second configuration to a third configuration in which the top sub section and the bottom sub section are decoupled from one another.

8. The method of claim 7, wherein during the applying of the second torque, the shear strength of the one or more shearable elements are overcome to allow the rotation of the top sub section from the second configuration to the third configuration.

9. The method of claim 7, wherein the torque ring is axially restrained to the top sub section via one or more retaining devices mechanically affixed to the torque ring and extending inwardly through a recess of the top sub section.

10. The method of claim 9, wherein the one or more retaining devices are positioned above the one or more shearable elements.

11. The method of claim 7, wherein each of the torque ring and the top sub section comprise a greater yield strength than each of the one or more shearable elements.

12. The method of claim 7, wherein the at least one upper torque protrusion includes a pair of diametrically opposed upper torque protrusions and the at least one lower torque protrusion includes a pair of diametrically opposed lower torque protrusions.

13. The method of claim 7, wherein the at least one upper torque protrusion and the at least one lower torque protrusion are positioned along a plane perpendicular to a central axis of the decoupling apparatus.

14. The method of claim 7, wherein the second torque is greater than the first torque.

* * * * *